United States Patent [19]

Sakaguchi et al.

[11] Patent Number: 5,065,727

[45] Date of Patent: Nov. 19, 1991

[54] AIR/FUEL RATIO CONTROL SYSTEM FOR INTERNAL COMBUSTION ENGINE

[75] Inventors: Shigeyuki Sakaguchi; Tadashi Ariga; Hirotsugu Maruyama, all of Kanagawa, Japan

[73] Assignee: Nissan Motor Company, Limited, Yokohama, Japan

[21] Appl. No.: 514,041

[22] Filed: Apr. 27, 1990

[30] Foreign Application Priority Data

Apr. 28, 1989 [JP] Japan ..... 1-111796

[51] Int. Cl.[5] ..... F02D 41/14; F02D 41/08

[52] U.S. Cl. ..... 123/489

[58] Field of Search ..... 123/440, 489

[56] References Cited

U.S. PATENT DOCUMENTS

| | | | |
|---|---|---|---|
| 4,509,489 | 4/1985 | Hasegawa et al. | 123/489 |
| 4,542,729 | 9/1985 | Yamato et al. | 123/489 |
| 4,572,129 | 2/1986 | Otobe | 123/440 |
| 4,589,390 | 5/1986 | Wazaki et al. | 123/489 |
| 4,751,909 | 6/1988 | Otobe | 123/489 |
| 4,878,472 | 11/1989 | Hibino | 123/489 |
| 4,913,120 | 4/1990 | Fujimoto et al. | 123/489 |
| 4,915,081 | 4/1990 | Fujimoto et al. | 123/489 |

FOREIGN PATENT DOCUMENTS 56-143325 11/1981 Japan .

*Primary Examiner*—Tony M. Argenbright
*Assistant Examiner*—Robert E. Mates
*Attorney, Agent, or Firm*—Foley & Lardner

[57] ABSTRACT

An air/fuel ratio control system for internal combustion engines performs λ control by using α correction coefficients variable depending upon oxygen concentration in the exhaust gas. The system derives an average value of the α correction coefficients for a predetermined time after the engine enters an idling state while the engine driving condition satisfies a predetermined feedback control for performing λ control, and modifies the average value by adding a predetermined value determined on the basis of an engine coolant temperature. The modified average value is set as a fixed value and is substituted for the α correction coefficient after the predetermined time elapses.

11 Claims, 4 Drawing Sheets

AIR/FUEL RATIO CONTROL SYSTEM FOR INTERNAL COMBUSTION ENGINE

BACKGROUND OF THE INVENTION

1. Field of the Invention

The present invention relates generally to an air/fuel ratio control system for an internal combustion engine for performing λ control or feedback control in order to maintain an air/fuel ratio close to a stoichiometric value. More specifically, the invention relates to an air/fuel ratio system which can perform λ control when the engine is driven in an idling state.

2. Description of the Background Art

As is well known, air/fuel ratio control for an air/fuel mixture to be introduced into an engine combustion chamber is performed by modifying a basic fuel delivery amount Tp, such as the basic fuel injection amount, which is generally derived on the basis of engine revolution speed and engine load represented by an intake air flow rate, for example, by utilizing a correction coefficient derived on the basis of an oxygen concentration dependent control parameter derived by monitoring oxygen concentration in the exhaust gas. The correction coefficient, which is variable depending on oxygen concentration in the exhaust gas, will be hereinafter referred to as the "α correction coefficient". The α correction coefficient is generally derived through a PI (proportional-integral) control process. The α correction coefficient consists of a lean mixture proportional component $P_L$ which is used when the air/fuel ratio varies from rich to lean across a stoichiometric value, a rich mixture proportional component $P_R$ which is used when the air/fuel ratio varies from lean to rich across the stoichiometric value, and a lean mixture integral component $I_L$ which is used while the air/fuel mixture is held lean, and a rich mixture integral component $I_R$ which is used while the air/fuel mixture is held rich. The integral components are derived by integrating an integral constant over a period while the air/fuel mixture is maintained rich or lean. In a practical process, the α correction coefficient is derived on the basis of the deviation of the air/fuel ratio from the stoichiometric value. Every time the air/fuel ratio varies from lean to rich or from rich to lean across the stoichiometric value, the air fuel ratio for the air/fuel mixture is controlled depending upon the proportional component $P_L$ or $P_R$.

In the case where the engine is driven in the idling state, the idling engine speed tends to change unsuitably even if the air/fuel ratio changes only slightly due to the α correction coefficient, and the engine speed becomes unstable in the idling state. Therefore, when the air/fuel ratio nearly approaches the stoichiometric value in the idling state, it is preferable to fix the α correction coefficient in order to stabilize the engine idling speed.

However, there are cases in which the air/fuel ratio deviates substantially from the stoichiometric value and is held lean due to dispersion or a change over time in the characteristics of a fuel injection valve or so forth. In this case, if λ control is not performed, engine stall may occur.

In order to eliminate the aforementioned disadvantage, an air/fuel ratio control system which is designed to fix the α correction coefficient for a predetermined period of time, or a predetermined number of cycles, after the engine enters an idling condition, is proposed in Japanese Patent First (unexamined) Publication (Tokkai Sho.) No. 56-143325. In this system, in order to suitably control the air/fuel ratio even if the air/fuel ratio deviates substantially from the stoichiometric value and is held lean or rich, λ control is performed for a predetermined period of time T after the engine starts to be driven in the idling state. The average of the α correction coefficients for the predetermined period of time T is fixed to the modified α correction coefficient which is used for deriving the fuel injection amount Ti, so as to stabilize engine idling speed.

However, the aforementioned system can not suitably control the air/fuel ratio, for example, when the engine coolant temperature is relatively low and a rich air/fuel mixture is required or so forth. That is, since the modified α correction coefficient is fixed to the average value of the α correction coefficients derived for the predetermined period of time, independent of the engine coolant temperature, an air/fuel mixture having the required air/fuel ratio can not be supplied to the engine when the engine coolant temperature is low.

Therefore, in the aforementioned system, it is not possible to prevent combustion conditions from worsening and/or avoid an unstable engine idling speed, when the engine coolant temperature is low.

SUMMARY OF THE INVENTION

It is therefore a principal object of the present invention to provide an air/fuel ratio control system which can perform λ control when the engine coolant temperature is within a predetermined range while the engine is driven in the idling state.

In order to accomplish the aforementioned and other objects, an air/fuel ratio control system includes means for deriving a fuel delivery amount by using a fixed correction value derived by adding a predetermined value determined on the basis of an engine coolant temperature, to an average value of correction values which is derived on the basis of oxygen concentration in the exhaust gas for a predetermined period of time after the engine is driven in an idling state while engine conditions require λ control.

According to one aspect of the present invention, an air/fuel ratio control system for an internal combustion engine comprises:

first detecting means for monitoring engine driving conditions including, engine revolution speed, engine load and engine coolant temperature to produce a first signal representative of the driving conditions thereof;

second detecting means for monitoring the air/fuel ratio of an air/fuel mixture discharged from a combustion chamber of the engine to produce a second signal representative thereof;

third detecting means for monitoring an engine driving condition to produce a third signal representative of an idling state when the engine is driven in the idling state;

first means for determining engine driving conditions satisfying a predetermined feedback control on the basis of the first signal;

second means for deriving a basic fuel delivery amount on the basis of the first signal;

third means for deriving a correction value for correcting the basic fuel delivery amount on the basis of the second signal;

fourth means for deriving an average value of the correction values for a predetermined period of time after the third signal representative of the idling state is input from the third detecting means while the engine is driven in the engine driving condition satisfying the predetermined feedback control, the fourth means modifying the average value of the correction values by adding thereto a predetermined value determined on the basis of the engine coolant temperature, and setting the modified average value as a fixed correction value; and fifth means for modifying the basic fuel delivery amount to derive a fuel delivery amount by using the correction value before the predetermined period of time elapses and by using the fixed correction value after the predetermined period of time elapses.

The average value is preferably an average of peak values of the correction values which fluctuate in a predetermined waveform. The average peak value is preferably an average value for a predetermined number of cycles of the fluctuating correction values after the third signal representative of the idling state is input from the third detecting means while the engine is driven in the engine driving condition satisfying the predetermined feedback control. The fourth means may further derive a weighted mean value of the preceding average peak value and an updated average peak value derived in a case where the third signal representative of the idling state is newly input from the third detecting means, and modify the weighted mean value to be set as the fixed correction value. The first detecting means may include a first sensor means for monitoring intake air flow rate and a second sensor means for monitoring an angular position of a crankshaft, and derive the basic fuel delivery amount on the basis of the intake air flow representative engine load and engine speed derived from the crankshaft angular position. The second detecting means may determine the air/fuel ratio of the air/fuel mixture on the basis of the oxygen concentration contained in the exhaust gas.

According to another aspect of the present invention, an air/fuel ratio control system for an internal combustion engine comprises:

an engine speed sensor for monitoring an engine revolution speed to produce an engine speed indicative signal;

an engine load sensor for monitoring an engine load condition to produce an engine load indicative signal;

an oxygen sensor for monitoring oxygen concentration in the exhaust gas to produce a rich/lean mixture indicative signal;

an engine coolant temperature sensor for monitoring engine coolant temperature to produce an engine coolant temperature indicative signal;

an idle switch which is turned on when the engine is driven in an idling state;

first means for detemining an engine driving condition satisfying a predetermined feedback control for performing λ control, on the basis of the engine coolant temperature indicative signal;

second means for deriving a basic fuel delivery amount on the basis of the engine speed indicative signal and the engine load indicative signal;

third means for deriving a correction value for correcting the basic fuel delivery amount on the basis of the rich/lean mixture indicative signal;

fourth means for deriving an average value of the correction values for a predetermined period of time after the idle switch is turned on while the engine is driven at the engine driving condition satisfying the predetermined feedback control, the fourth means modifying the average value of the correction values by adding thereto a predetermined value determined on the basis of the engine coolant temperature indicative signal, and setting the modified average value as a fixed correction value; and fifth means for modifying the basic fuel delivery amount to derive a fuel delivery amount using the correction value before the predetermined period of time elapses and by using the fixed correction value after the predetermined period of time elapses.

BRIEF DESCRIPTION OF THE DRAWINGS

The present invention will be understood more fully from the detailed description given herebelow and from the accompanying drawings of the preferred embodiment of the invention. However, the drawings are not intended to imply limitation of the invention but are for explanation and understanding only.

In the drawings.

DESCRIPTION OF THE PREFERRED EMBODIMENT

Figure 1:
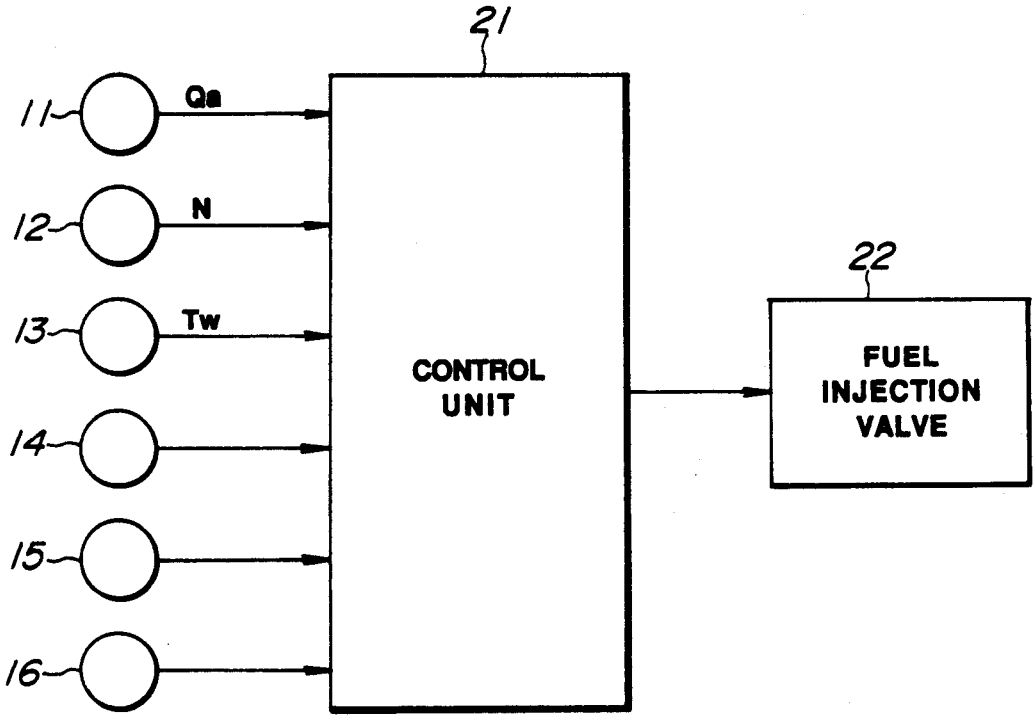
FIG. 1 is a block diagram of an air/fuel ratio control system, according to the present invention.

Referring now to the drawings, particularly to FIG. 1, the preferred embodiment of an air/fuel ratio control system, according to the present invention, disclosed herebelow, is associated with a fuel injection control system for injecting a controlled amount of fuel to an air induction system of an internal combustion engine, such as a so-called L-jetronics type fuel injection internal combustion engine.

In the embodiment shown, the air/fuel ratio control system generally comprises various sensors, such as an intake air flow rate sensor 11, a crank angle sensor 12, an engine coolant temperature sensor 13 and an air/fuel ratio sensor 14, a control unit 21 and a fuel injection valve 22.

The intake air flow rate sensor 11 is provided for monitoring an intake air flow rate representative of engine load to produce an intake air flow rate indicative signal $Q_a$. The intake air flow rate sensor 11 may comprise, for example, a flap type sensor, hot-wire type sensor or the like.

The crank angle sensor 12 is provided for monitoring the angular position of a crankshaft to produce a crank reference signal $\theta_{ref}$ at every predetermined angular position, e.g. every 70° BTDC (before top-dead-center) position, of the crankshaft, and a crank position signal $\theta_{pos}$ at every given angular displacement, e.g. 1°. The crank angle sensor 12 is disposed within an engine accessory, such as a distributor, which rotates synchronously with revolution of the engine for monitoring the crankshaft angular position.

The engine coolant temperature sensor 13 is disposed within an engine coolant passage for monitoring engine coolant temperature to produce an engine coolant temperature indicative signal $T_w$.

The air/fuel ratio sensor 14 is disposed within an exhaust passage for monitoring an air/fuel ratio in exhaust gas. The air/fuel ratio sensor 14 may be, for example, an oxygen ($O_2$) sensor which monitors oxygen concentration contained in exhaust gas to produce an $O_2$ signal. As will be described hereinafter, the $O_2$ signal is used for air/fuel feedback control.

These sensors 11 to 14 are electrically connected to the control unit 21 for outputting the sensor signals thereto.

An idle switch 15 is also electrically connected to the control unit 21 for monitoring acceleration enrichment demand. The idle switch 15 produces an ON signal when the engine is driven in an idling state in which a throttle valve is fully closed. Naturally, whether or not the engine is driven in an idling state may also be determined by the detected vehicular speed, the intake back pressure or the engine speed.

In addition, an ignition switch 16 is electrically connected to the control unit 21 for monitoring the engine starting operation.

The control unit 21 generally comprises a microcomputer which controls the fuel injection valve 22 by executing a control program in the CPU thereof.

Figure 2:
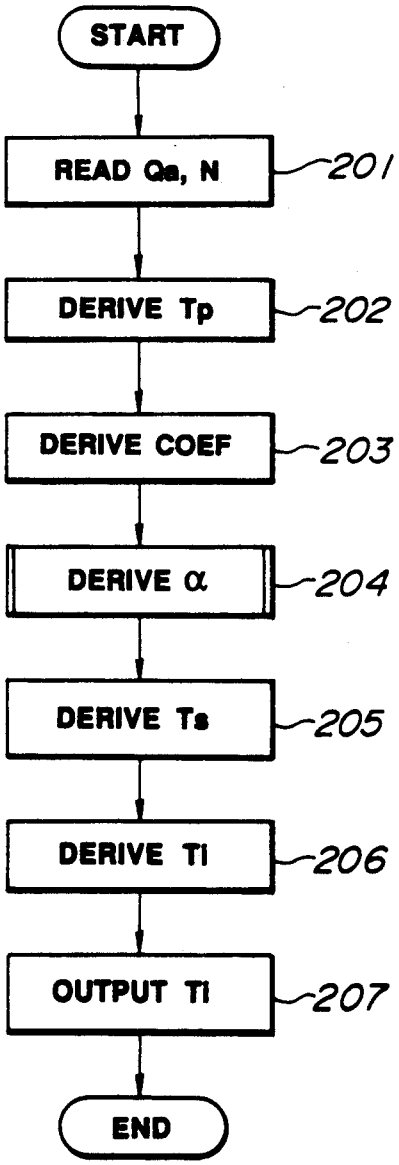
FIG. 2 is a flow chart showing a process for deriving a fuel injection amount, as executed by a control unit of the air/fuel ratio control system of FIG. 1.

FIG. 2 shows a flow chart of a process for deriving a fuel injection amount Ti, which is carried out by the control unit 21. The fuel injection amount Ti is used for injecting a controlled amount of fuel through the fuel injection valve 22.

First, the intake air flow rate Qa and the engine speed N are input at step 201.

Then, at step 202, a basic fuel injection amount Tp is derived by the following equation:

$$Tp = K \times Qa/N \text{(K: constant)}$$

The engine speed N may be derived in the control unit 21 on the basis of one of the crank reference signal $\theta_{ref}$ and the crank position signal $\theta_{pos}$. Practically, when the engine speed N is derived on the basis of the crank position signal $\theta_{ref}$, an interval of occurrence of sequentially occurring crank reference signals is measured and a reciprocal of the measured interval is used as engine speed representing data. On the other and, when the crank position signal $\theta_{pos}$ is used for deriving the engine speed N, the crank position signal is counted for a given period of time in which a given number of crank position signals are received. In the former case, the engine speed N is derived in a value proportional to the counted value of the crank position signals. On the other hand, in the latter case, a reciprocal of the measured period is divided by the given number of crank position signals to obtain the pulse interval and a reciprocal of the interval obtained is used as the engine speed N.

At step 203, a COEF which is a combined correction coefficient, such as a cold engine enrichment correction coefficient, an engine acceleration enrichment correction coefficient and so forth, is derived.

At step 204, an $\alpha$ a correction coefficient which is provided for performing $\lambda$ control, is derived. The $\alpha$ correction coefficient is generally derived on the basis of the oxygen concentration in the exhaust gas, i.e. on the basis of the $O_2$ signal.

At step 205, a Ts correction coefficient which is a correction value for compensating for battery voltage, is derived.

At step 206, the fuel injection amount Ti is derived. As is well known, the fuel injection amount Ti is determined by the following equation:

$$Ti = Tp \times \text{COEF} \times \alpha + Ts$$

Finally, at step 207, the fuel injection amount Ti is set in a Ti register in an output unit of the microcomputer for triggering a driver circuit at a predetermined time in relation to the engine revolution cycle to maintain a valve actuator of the fuel injection valve in a valve open position for a period of time corresponding to the fuel injection amount Ti.

Figure 3:
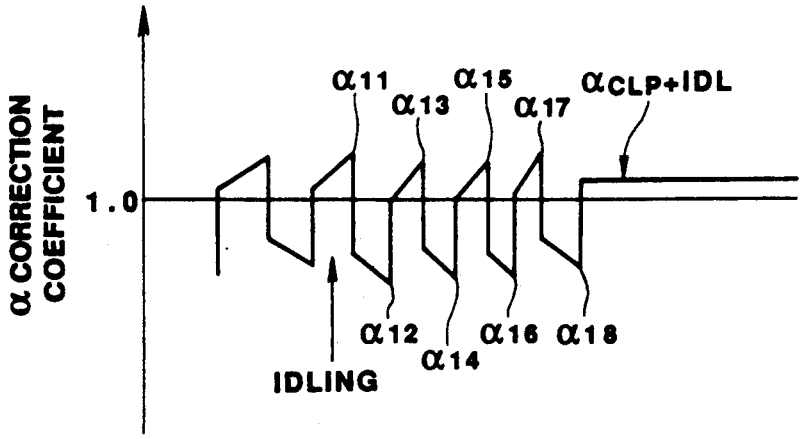
FIG. 3 is a graph showing waveform characteristics of α correction coefficient which is derived by the control unit of FIG. 1 when the engine is driven in an idling state while λ control conditions are satisfied, and which is used for the process of FIG. 2.
Figure 4:
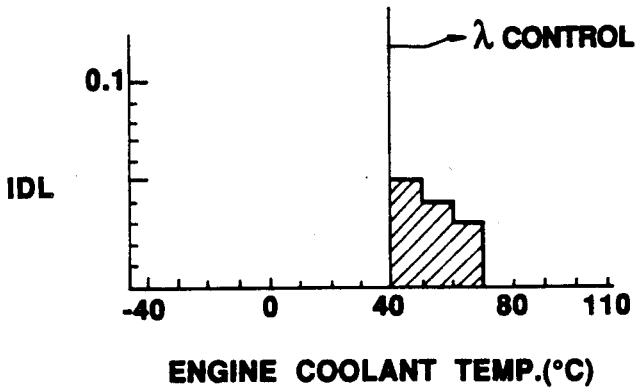
FIG. 4 is a graph showing the relationship between the engine coolant temperature and the enrichment coefficient which is added to the average of the α correction coefficients for predetermined cycles.

According to the present invention, the $\alpha$ correction coefficient is modified by adding a predetermined value IDL to the average value of the $\alpha$ correction coefficient, as shown in FIG. 3. That is, first of all, the $\alpha$ correction coefficient is derived on the basis of deviation of the actual air/fuel ratio from the required air/fuel ratio for four cycles after the engine starts to be driven in the idling state. Then, the average of the peak values $\alpha_{11}$ to $\alpha_{18}$ of the $\alpha$ correction coefficients for four cycles is derived. This average is added to the predetermined value IDL which will be referred to as an "enrichment coefficient". The enrichment coefficient IDL may be set as shown in FIG. 4. In the embodiment shown, the set enrichment coefficient IDL is 0.05 when the detected engine coolant temperature $T_w$ is between 40° C. and 50° C., it is 0.04 when $T_w$ is between 50° C. and 60° C., and it is 0.03 when $T_w$ is between 60° C. and 70° C. When the temperature $T_w$ is less than 40° C., the enrichment coefficient IDL is not set since $\lambda$ control is not performed at this temperature. On the other hand, when the temperature $T_w$ is greater than 70° C., the enrichment coefficient IDL is zero. The derived value is fixed and used as the $\alpha$ correction value for deriving the fuel injection amount $T_i$ in FIG. 2.

Figure 5:
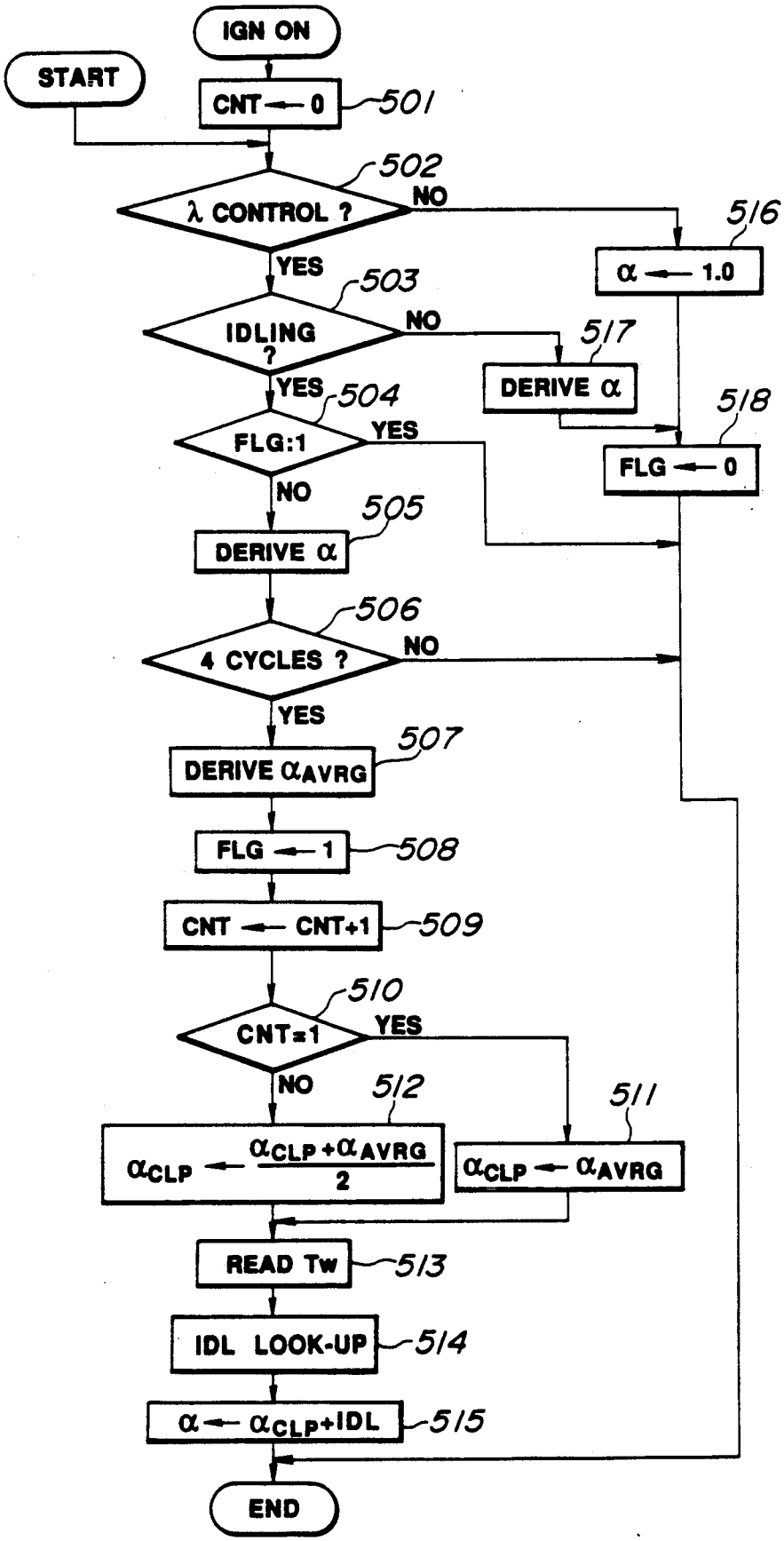
FIG. 5 is a program for deriving a modified α correction coefficient which is used in the process of FIG. 2.

FIG. 5 shows a routine for deriving the $\alpha$ correction coefficient, execution of which starts in response to turning ON the ignition switch 16 and then is repeatedly executed thereafter at a predetermined interval.

First, when the ignition switch 16 is turned ON, a counter is set to be 0 at step 501 and the routine goes to step 502.

At step 502, it is determined whether or not a closed loop is established, i.e. the feedback control or $\lambda$ control is required. For example, $\lambda$ control is required when the detected engine coolant temperature $T_w$ is greater than 40° C. When $\lambda$ control is required, the routine goes to step 303, and when it is not required, the routine goes to step 516.

At step 503, it is determined whether or not the engine driving state is the idling state. When it is the idling state, the routine goes to step 504, and when it is not the idling state, the routine goes to step 517.

At step 504, it is determined whether or not a flag is 1. When the flag is 1, the routine ends, and when the flag is not 1, the routine goes to step 505. As will be described hereinafter, the flag is set to be 1 at step 508 after the average of the $\alpha$ correction coefficients is derived at step 507. Therefore, the flag being set to 1 means that the derived average was already used for modifying the $\alpha$ correction coefficient.

At step 505, the $\alpha$ correction coefficient is derived on the basis of deviation of the detected air/fuel ratio from the required air/fuel ratio, and then the routine goes to step 506.

At step 506, it is determined whether or not the $\alpha$ correction coefficients have been derived for four cycles while the engine is being driven in the idling state. When it is YES, the routine goes to step 507, and when it is NO, the routine goes to the end so that it is repeated until the $\alpha$ correction coefficients are derived for four cycles.

At step 507, the average peak value $\alpha_{AVRG}$ of the $\alpha$ correction coefficients for four cycles is derived, and then the routine goes to step 508. At step 508, the flag is set to be 1, and then the routine goes to step 509. At step 509, the counter value CNT is increased by 1, and then the routine goes to step 510.

At step 510, it is determined whether or not the counter value CNT is 1. When the counter value CNT is 1, the routine goes to step 511, and when it is not 1, the routine goes to step 512. The counter value CNT of 1 means that the average peak value $\alpha_{AVRG}$ is initially derived, i.e. the initial engine idling state is monitored while the $\lambda$ control is required. On the other hand, the counter value CNT other than 1 means that the average peak value $\alpha_{AVRG}$ is not initially derived, i.e. the idling state is monitored again after the initial idling state is previously monitored while the $\lambda$ control is required.

At step 511, the average peak value $\alpha_{AVRG}$ is used as an $\alpha_{CLP}$ which will be used for modifying the $\alpha$ correction coefficient step 515. On the other hand, the weighted mean value of the average peak value $\alpha_{AVRG}$ and the preceding $\alpha_{CLP}$ is used as a new $\alpha_{CLP}$. After step 511 or 512, the routine goes to step 513.

At step 513, the detected engine coolant temperature $T_w$ is read, and then the routine goes to step 614 in which the enrichment coefficient IDL is read from FIG. 4 in accordance with the detected engine coolant temperature $T_w$. Then, at step 515, the increment coefficient IDL is added to the average peak value or weighted mean value $\alpha_{CLP}$, and the added value is used as the $\alpha$ correction coefficient (fixed correction coefficient) in the process for deriving the fuel injection amount Ti as shown in FIG. 2.

As mentioned above, when it is determined that $\lambda$ control is not required at step 502, the routine goes to step 516. At step 516, the $\alpha$ correction coefficient is set to be 1 which means that $\lambda$ control is not performed. When it is determined that the engine driving state is not the idling state at step 503, the routine goes step 517. At step 517, the $\alpha$ correction coefficient is derived on the basis of deviation of the detected air/fuel ratio from the required air/fuel ratio. In this case, modification of the $\alpha$ correction coefficient as shown in steps 506 to 515 is not performed. After step 516 or 517, the routine goes to step 518 in which the flag is set to be 0.

Figure 6:
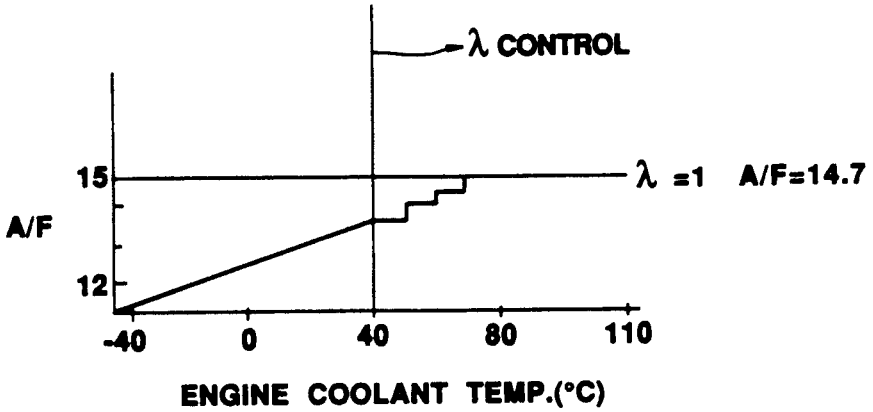
FIG. 6 is a graph showing the relationship between the engine coolant temperature and the air/fuel ratio in a case where the modified α correction coefficient is used for deriving the fuel injection amount, according to the present invention.

As mentioned above, according to the present invention, the enrichment coefficient IDL depending upon the detected engine coolant temperature $T_w$ is added to the average peak value of the $\alpha$ correction coefficients for a predetermined time after the engine starts to be driven in the idling state, and the $\alpha$ correction coefficient used for deriving the fuel injection amount Ti is fixed to the added value. Therefore, it is possible to prevent the air/fuel ratio from unsuitably changing when the engine is driven in the idling state, and to achieve the suitable air/fuel state for the engine coolant temperature $T_w$, as shown in FIG. 6.

Therefore, according to the present invention, it is possible to prevent the $\alpha$ correction coefficient from influencing the idling engine speed, and to maintain optimal conditions for engine combustion even if the engine coolant temperature $T_w$ is relatively low. As a result, it is possible to substantially stabilize engine idling speed.

What is claimed is:

1. An air/fuel ratio control system for an internal combustion engine, which comprises;

first detecting means for monitoring engine driving conditions including engine revolution speed, engine load and engine coolant temperature to produce a first signal representative of the driving conditions thereof;

second detecting means for monitoring the air/fuel ratio of an air/fuel mixture to be discharged from a combustion chamber of the engine to produce a second signal representative thereof;

third detecting means for monitoring an engine driving condition to produce a third signal representative of an idling state when the engine is driven in the idling state;

first means for determining engine driving conditions satisfying a predetermined feedback control on the basis of the first signal;

second means for deriving a basic fuel delivery amount on the basis of the first signal;

third means for deriving a correction value for correcting said basic fuel delivery amount on the basis of the second signal;

fourth means for deriving an average value of said correction values for a predetermined period of time after said third signal representative of the idling state is input from said third detecting means while the engine is driven at said engine driving conditions satisfying the predetermined feedback control, said fourth means modifying said average value of the correction values by adding thereto a predetermined value determined on the basis of said engine coolant temperature, and setting the modified average value as a fixed correction value; and fifth means for modifying said basic fuel delivery amount to derive a fuel delivery amount by using said correction value before said predetermined period of time elapses and by using said fixed correction value after said predetermined period of time elapses.

2. An air/fuel ratio control system as set forth in claim 1, wherein said average value is an average of peak values of said correction values, which fluctuate in a predetermined waveform.

3. An air/fuel ratio control system as set forth in claim 2, wherein said average peak value is an average value of a predetermined number of cycles of the fluctuating correction values after said third signal representative of the idling state is input from said third detecting means while the engine is driven at said engine driving condition satisfying the predetermined feedback control.

4. An air/fuel ratio control system as set forth in claim 2, wherein said fourth means further derives a weighted means value of the preceding average peak value and an updated average peak value derived in a case where said third signal representative of the idling state is newly input from said third detecting means, and modifies said weighted means value to be set as said fixed correction value.

5. An air/fuel ratio control system as set forth in claim 1, wherein said first detecting means includes a first sensor means for monitoring an intake air flow rate and a second sensor means for monitoring an angular position of a crankshaft, and wherein said second deriving means derives the basic fuel delivery amount on the basis of intake air flow, representative of engine load, and of an engine speed derived from the crankshift angular position.

6. An air/fuel ratio control system as set forth in claim 1, wherein said second detecting means determines the air/fuel ratio of the air/fuel mixture on the basis of an oxygen concentration contained in the exhaust gas.

7. An air/fuel ratio control system for an internal combustion engine, which comprises:

an engine speed sensor for monitoring an engine revolution speed to produce an engine speed indicative signal;

an engine load sensor for monitoring an engine load condition to produce an engine load indicative signal;

an oxygen sensor for monitoring oxygen concentration in an exhaust gas to produce a rich/lean mixture indicative signal;

an engine coolant temperature sensor for monitoring engine coolant temperature to produce an engine coolant temperature indicative signal;

an idle switch which is turned on when the engine is driven in an idling state;

first means for determining an engine driving condition satisfying a predetermined feedback control for performing λ control, on the basis of said engine coolant temperature indicative signal;

second means for deriving a basic fuel delivery amount on the basis of said engine speed indicative signal and said engine load indicative signal;

third means for deriving a correction value for correcting said basic fuel delivery amount on the basis of said rich/lean mixture indicative signal;

fourth means for deriving an average value of said correction values for a predetermined period of time after said idle switch is turned on while the engine is driven at said engine driving condition satisfying the predetermined feedback control, said fourth means modifying said average value of the correction values by adding thereto a predetermined value determined on the basis of said engine coolant temperature indicative signal, and setting the modified average value as a fixed correction value; and fifth means for modifying said basic fuel delivery amount to derive a fuel delivery amount by using said correction value before said predetermined time elapses and by using said fixed correction value after said predetermined period of time elapses.

8. An air/fuel ratio control system as set forth in claim 7, wherein said average value is an average of peak values of said correction values, which fluctuate in a predetermined waveform.

9. An air/fuel ratio control system as set forth in claim 8, wherein said average peak value is an average value of a predetermined number of cycles of the fluctuating correction values after said idle switch is turned on while the engine is driven at said engine driving condition satisfying the predetermined feedback control.

10. An air/fuel ratio control system as set forth in claim 8, wherein said fourth means further derives a weighted mean value of the preceding average peak value and an updated average peak value derived in a case where said idle switch is turned on again after it is turned off, and modifies said weighted mean value to be set as said fixed correction value.

11. An air/fuel ratio control system for an internal combustion engine when said engine is idling, said air/fuel ratio control system comprising:

engine coolant temperature sensor means for detecting a coolant temperature of said engine and generating an engine temperature indicative signal indicative of said coolant temperature detected;

air/fuel ratio sensor means for detecting a concentration of a predetermined component of exhaust gases issued from said engine and generating an air/fuel ratio indicative signal indicative of said concentration detected;

crank angle sensor means for detecting a revolution speed of said engine and generating an engine revolution speed indicative signal indicative of said revolution speed detected;

means for detecting a load on said engine and generating an engine load indicative signal indicative of said load detected;

a control unit including means for storing temperature dependent enrichment coefficient values versus varying engine coolant temperature values, said control unit being operatively coupled with said engine coolant temperature sensor means, said air/fuel ratio sensor means, said crank angle sensor means and said load detecting means, said control unit including means for determining a basic fuel injection amount in response to said engine coolant temperature indicative signal, said air/fuel ratio indicative signal, said engine revolution speed indicative signal and said engine load indicative signal, deriving one of said temperature dependent enrichment coefficient values for said engine temperature indicative signal when said engine is idling, and modifying said fuel injection amount determined by said one of said temperature dependent enrichment coefficient values derived to determine an idling fuel injection amount, and generating an output signal indicative of said idling fuel injection amount; and means for supplying fuel to said engine in response to said output signal.

* * * * *